US005149035A

United States Patent [19]

Bonnema et al.

[11] Patent Number: 5,149,035

[45] Date of Patent: Sep. 22, 1992

[54] CHAIR BASE AND POST ASSEMBLY FOR AN OFFICE CHAIR

[75] Inventors: Mark J. Bonnema, East Grand Rapids; David J. Morrison, Allendale, both of Mich.

[73] Assignee: The Shaw-Walker Company, Muskegon, Mich.

[21] Appl. No.: 512,903

[22] Filed: Apr. 23, 1990

Related U.S. Application Data

[63] Continuation of Ser. No. 239,462, Sep. 1, 1988, abandoned.

[51] Int. Cl.[5] ..... F16M 11/00

[52] U.S. Cl. ..... 248/188.7; 248/415; 297/347

[58] Field of Search ..... 297/345, 347

[56] References Cited

U.S. PATENT DOCUMENTS

| | | | |
|---|---|---|---|
| 2,543,924 | 3/1951 | Mondy | 248/406.1 |
| 3,526,380 | 9/1970 | Tong | 248/188.7 X |
| 3,682,425 | 8/1972 | Vincent et al. | 248/188.7 |
| 3,923,280 | 12/1975 | Good | 248/415 X |
| 4,234,152 | 11/1980 | Browse | 297/349 X |
| 4,595,237 | 6/1986 | Nelsen . | |
| 4,598,892 | 7/1986 | Franckowiak et al. . | |
| 4,699,344 | 10/1987 | Vaughan | 248/188.7 |
| 4,718,726 | 1/1988 | Estkowski et al. . | |
| 4,720,071 | 1/1988 | Nelson et al. . | |

FOREIGN PATENT DOCUMENTS

| | | | |
|---|---|---|---|
| 45151 | 2/1982 | European Pat. Off. | 248/188.7 |
| 1296760 | 2/1966 | Fed. Rep. of Germany . | |
| 1341308 | 9/1963 | France | 248/188.5 |
| 225063 | 12/1942 | Switzerland | 248/161 |
| 430098 | 12/1964 | Switzerland . | |
| 2021940 | 12/1979 | United Kingdom . | |
| 2035068 | 6/1980 | United Kingdom | 248/188.7 |

*Primary Examiner*—Alvin C. Chin-Shue
*Attorney, Agent, or Firm*—Kinzer, Plyer, Dorn, McEachran & Jambor

[57] ABSTRACT

A chair base and post assembly for an office chair in which the base is formed of one piece of injection molded plastic. The base includes a central tubular hub and integral base arms which extend from the hub. A partially tapered socket extends vertically through the hub. A steel post tube is positioned in the socket and is supported to extend above the hub by a ring welded to the outside of the post tube, which ring rests on the top of the hub. A steel sleeve located in the socket near the top thereof and an internal surface formed as an internal surface of the socket at the bottom thereof provide annular surfaces which engage the post tube to stabilize it vertically. A plastic guide bushing fits inside the steel post tube at its top and receives the pneumatic lift cylinder to stabilize and guide it during its extensions and retractions.

5 Claims, 2 Drawing Sheets

CHAIR BASE AND POST ASSEMBLY FOR AN OFFICE CHAIR

This is a continuation of copending application Ser. No. 07/239,462 filed on Sep. 1, 1988 now abandoned.

BACKGROUND AND SUMMARY OF THE INVENTION

The invention is directed to a chair base and post assembly for an office chair in which the chair base is formed in one piece of injection molded plastic.

An object of this invention is a chair base and post assembly in which a steel post is mounted in a plastic hub and is supported so as to transfer its load vertically onto the hub with the hub also stabilizing the post tube against tilting.

Another object of this invention is a plastic chair base having a hub with a socket that permits easy removal of the molding tools yet provides non-tapered annular bearing surfaces to stabilize a steel post tube which is positioned in the socket.

Another object of this invention is a plastic chair base having a hub with a socket in which the hub itself provides a lower annular bearing surface to stabilize a steel post tube positioned in the socket and a steel sleeve near the upper end of the socket provides another annular bearing surface to stabilize the post tube.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 2:
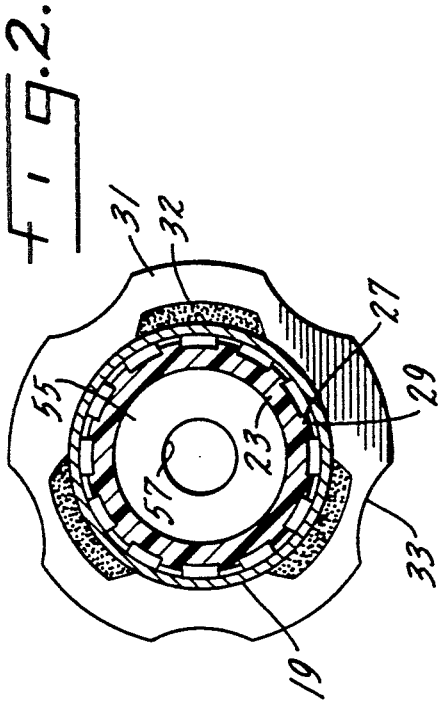
FIG. 2 is an enlarged cross-sectional view taken along line 2—2 of FIG. 1 with some parts omitted for clarity of illustration.
Figure 1:
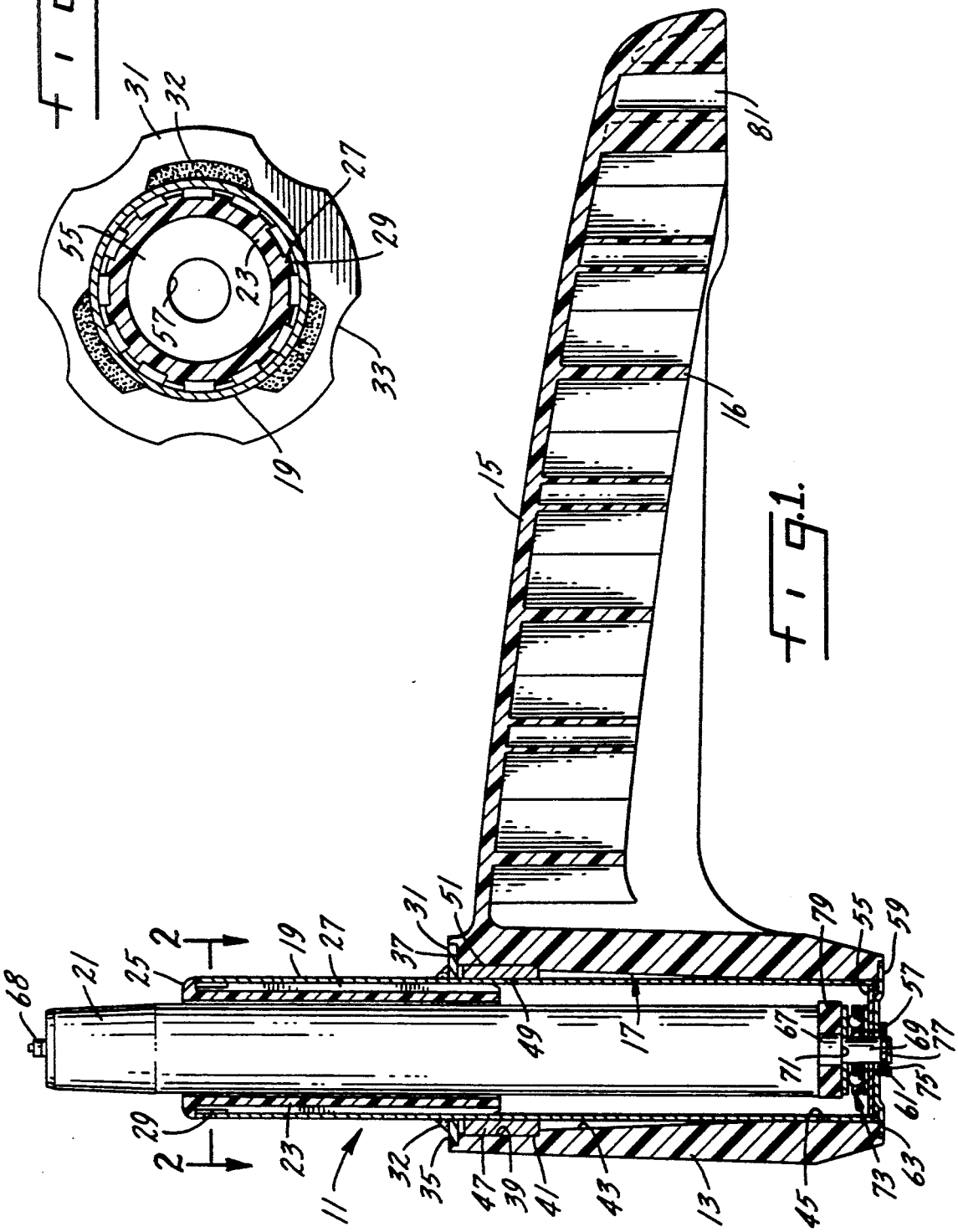
FIG. 1 is a vertical cross-sectional view through the chair base and post assembly.
Figure 3:
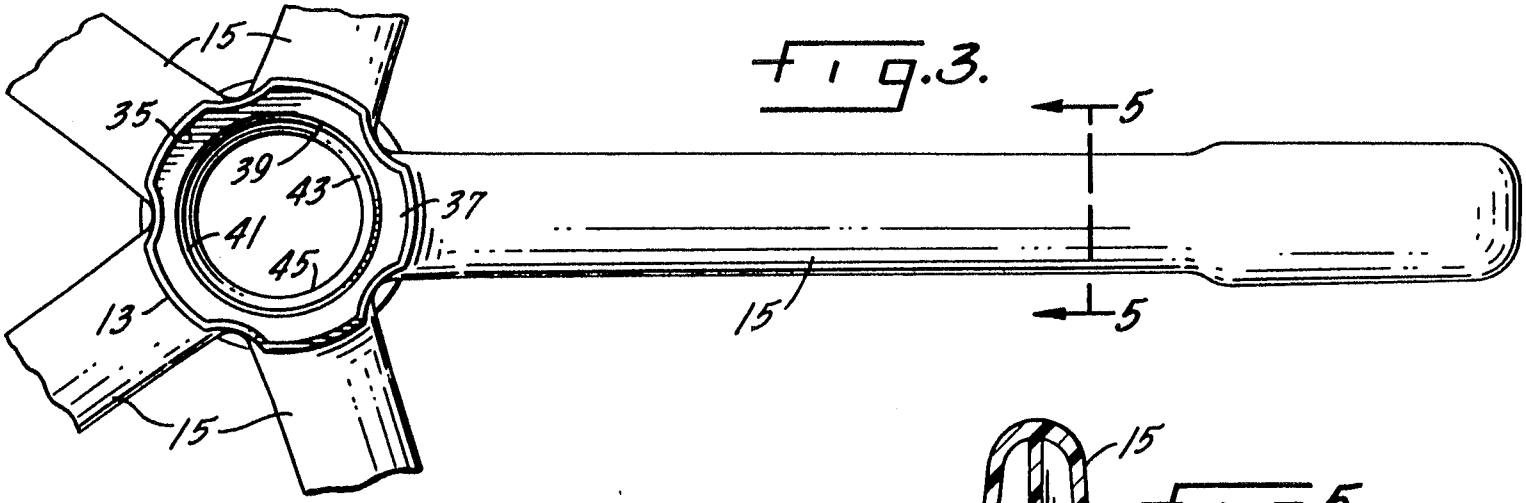
FIG. 3 is a top plan view of the chair base and post assembly of FIG. 1 with some parts broken away and others omitted for clarity of illustration.
Figure 5:
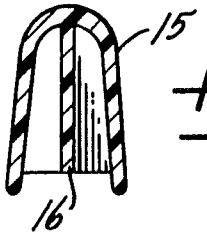
FIG. 5 is a cross-sectional view taken along line 5—5 of FIG. 3.
Figure 4:
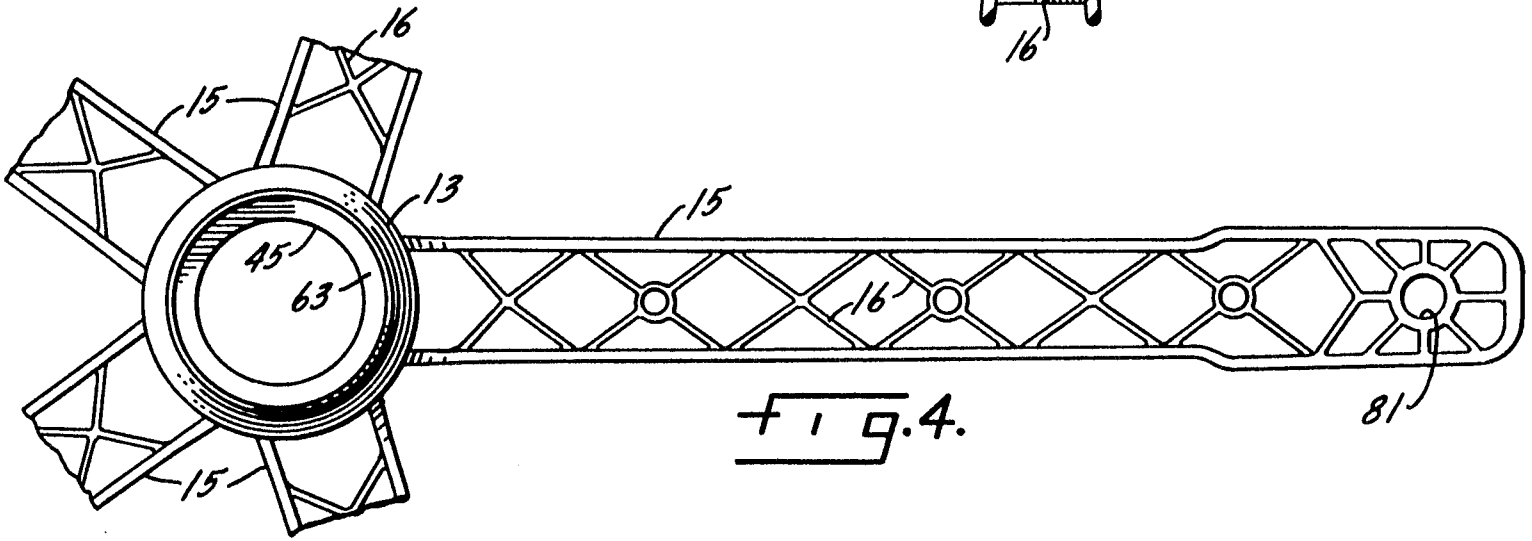
FIG. 4 is a bottom plan view of the chair base and post assembly of FIG. 3.

FIG. 1 of the drawings is a cross-sectional view showing a chair base and post assembly 11 embodying the novel features of this invention. The chair base and post assembly includes a hub 13 with five integral arms 15 which are formed in one piece by injection molding of plastic. The arms are molded of thin walled, somewhat parabolic cross-section with honeycombed reinforcing ribs and ejection pin tubes 16, as shown in FIGS. 1 and 3 of the drawings. Any suitable high strength plastic may be used to injection mold the integral base and arms. A plastic found to be suitable is nylon resin plastic sold by E. I. du Pont de Nemours & Co. under the designation "Zytel 72G33 nylon resin."

A socket 17 formed in the hub 13 extends therethrough from top to bottom. A steel post tube 19 is mounted in the socket and projects upwardly above the socket. A pneumatic lift cylinder 21 telescopes inside and projects upwardly beyond the top of the steel post tube. A plastic guide bushing 23 seats in the upper end of the steel post tube to guide and stabilize the pneumatic lift cylinder. To secure the plastic guide bushing in position at the upper end of the steel tube 19, a collar 25 which is formed integrally with the plastic guide bushing rests on the upper end of the steel post 19. Ribs 27 spaced around the outer periphery of the plastic guide bushing below the collar 25 engage the inside surface of the steel post tube 19 to prevent the plastic guide bushing from rotating inside the steel post tube. The ribs 27 are notched partially at 29 just below the collar 25.

A scalloped steel washer 31 is welded at 32 to the outside of the steel post tube 19. In this example of the invention, five cutouts 33 are formed in the washer, with each cutout being positioned between a pair of converging arms 15 extending from the hub 13 of the chair base, as can be best seen in FIG. 3 of the drawings. The scalloped washer fits into a corresponding scalloped notch 35 formed in the top of the hub 13 and rests on a shoulder 37 defining the bottom of the notch to thereby transfer the weight of the post tube 19 vertically onto the hub 13.

The remainder of the socket 17 below the scalloped notch 35 is of irregular cross-section and includes a slightly tapered cylindrical portion or counterbore 39 located below the shoulder 37. The taper which provides draft for removal of the molding tool from the cylindrical portion 39 need only be approximately 0.5 degrees. A shoulder 41 defines the lower portion of the slightly tapered cylindrical portion 39. A convergently tapered portion 43 extends downwardly from the shoulder 41 and a cylindrical portion 45 without any taper is formed at the lower end of the socket 17. The cylindrical portion 45 provides an annular wall which engages the outer wall of the steel post tube 19 to stabilize the post tube against lateral moving or tilting. To stabilize the post tube 19 at the upper end of the hub 13, a steel sleeve 47, having a cylindrical inner wall 49 which engages the cylindrical outer wall of the steel post tube 19, is positioned in the cylindrical portion 39 and rests on the shoulder 41. The outer wall 51 of the steel sleeve 47 has a taper corresponding to the taper of the cylindrical portion 39 so that the sleeve 47 is fully contacting the slightly tapered cylindrical portion 39 of the hub. As can be seen from the drawings, the outer surface of the wall of the steel post tube 19 does not engage the socket wall in the space between the steel sleeve 47 and the lower cylindrical portion 45 of the hub.

A cylindrical washer 55 is welded to the steel post tube just inside the lower end of the tube. The cylindrical washer has an opening 57 in the center thereof. A steel hat washer 59 having a center opening 61 which aligns with and is the same diameter as the center opening 57 of the cylindrical washer 55 is force fitted into an annular notch 63 formed at the lower end of the hub and engages the cylindrical washer 55.

The pneumatic lift cylinder 21 has a piston rod 67 extending out of the bottom and a plastic actuating button 68 at the top thereof. The rod has an end portion 69 of reduced diameter providing a downwardly facing annular shoulder 71. The shoulder 71 rests on a ball bearing assembly 73 which is supported on the cylindrical washer 55 welded to the post tube 19 near the bottom thereof. The reduced diameter end portion 69 of the piston rod extends through the openings 57 and 61 in the washers 55 and 59, respectively, and projects out of the bottom of the post tube 19. A clip 75 fits into a notch 77 formed in the end portion 69 of the piston rod 67 and secures it against upward movement. A resilient rubber washer 79 is positioned between the bottom of the lift cylinder and the ball bearing assembly.

As is conventional, the upper end of the pneumatic lift cylinder 21 is tapered to fit into a socket located on the underside of a chair seat, but which is not shown. Caster sockets 81 are formed in the ends of the arms 15 to receive conventional chair casters which are not shown.

We claim:

1. A chair base and post assembly for an office chair including:

a base formed of plastic and having a central tubular hub and base arms extending radially from the hub, said hub having a socket extending vertically therethrough, said socket having an irregular cross-section which is larger at the top than at the bottom of the socket and having a counterbore formed in the socket near said top, a cylindrical post tube positioned in said socket and extending out of said socket above said hub, means attached to the outside of said post tube and resting on said hub to support said post tube, annular internal surface located in the socket near the top and bottom thereof to engage said post tube to stabilize it against lateral movement, said annular internal surface located in the socket near the bottom thereof being formed as a non-tapered internal wall of the hub and said annular internal surface located in the socket near the top thereof being formed as the internal wall of a sleeve seated in said counterbore in the socket near the top thereof, and means located at the bottom of said post tube to support a lifting mechanism positioned in said post tube.

2. The chair base and post assembly of claim 1 in which a portion of the socket between said annular internal surfaces is tapered and not in contact with the cylindrical post sleeve.

3. The chair base and post assembly of claim 1 further including means formed on said post tube and said hub to prevent rotation of said post tube and said hub relative to each other.

4. The chair base and post assembly of claim 3 further characterized in that said means to prevent rotation of said post tube and said hub relative to each other includes at least one engageable projection and complementary recess formed on said means attached to the outside of said post tube and on said hub.

5. An office chair base molded in a single piece of plastic and having a central hub with radially extending base arms and a socket to receive a post tube having a shoulder, said socket extending vertically through said hub, said socket being of irregular cross-section decreasing in diameter from the top to the bottom, a non-tapered annular wall located near the bottom of the socket to engage the post tube when inserted in the socket to stabilize the post tube against lateral movement, a slightly tapered, enlarged counterbore at the top of the socket to receive a sleeve, a sleeve adapted to seat in said counterbore and having an inner surface positioned to engage said post tube to stabilize it against lateral movement, the portion of the socket between the counterbore and the non-tapered annular wall being tapered so as to be out of contact with the post tube inserted in the socket, and a support surface formed at the top of the hub to engage the shoulder of the post tube to support the post tube.

* * * * *